US005321304A

United States Patent [19]

Rostoker

[11] Patent Number: 5,321,304

[45] Date of Patent: Jun. 14, 1994

[54] DETECTING THE ENDPOINT OF CHEM-MECH POLISHING, AND RESULTING SEMICONDUCTOR DEVICE

[75] Inventor: Michael D. Rostoker, San Jose, Calif.

[73] Assignee: LSI Logic Corporation, Milpitas, Calif.

[21] Appl. No.: 33,832

[22] Filed: Mar. 19, 1993

Related U.S. Application Data

[62] Division of Ser. No. 911,851, Jul. 10, 1992, Pat. No. 5,265,378.

[51] Int. Cl.[5] ..... H01L 23/48; H01L 29/44; H01L 29/52; H01L 29/60

[52] U.S. Cl. ..... 257/621; 257/798; 257/638

[58] Field of Search ..... 257/304, 621, 798, 638; 437/8; 156/627

[56] References Cited

U.S. PATENT DOCUMENTS

| | | | |
|---|---|---|---|
| 3,685,209 | 8/1972 | Lambert | 51/14 |
| 3,821,815 | 6/1974 | Abbott et al. | 360/110.2 C |
| 3,841,031 | 10/1974 | Walsh | 51/283 |
| 4,014,141 | 3/1977 | Riddle et al. | 51/165 R |
| 4,155,106 | 5/1979 | Muraoka et al. | 360/112 |
| 4,193,226 | 3/1980 | Gill, Jr. et al. | 51/124 R |
| 4,312,732 | 1/1982 | Degenkolb et al. | 204/192 E |
| 4,491,499 | 1/1985 | Jerde et al. | 156/626 |
| 4,511,942 | 4/1985 | Valstyn | 360/126 |
| 4,559,743 | 12/1985 | Kracke et al. | 51/165 R |
| 4,671,851 | 6/1987 | Beyer et al. | 156/645 |
| 4,708,770 | 11/1987 | Pasch | 156/662 |
| 4,793,895 | 12/1988 | Kaanta et al. | 156/662 |
| 4,811,522 | 3/1989 | Gill, Jr. | 51/131.1 |
| 4,879,257 | 11/1989 | Patrick | 437/195 |
| 4,910,155 | 3/1990 | Cote et al. | 437/8 |
| 4,912,883 | 4/1990 | Chang et al. | 51/165 R |
| 4,914,868 | 4/1990 | Church et al. | 51/165.71 |
| 4,944,836 | 7/1990 | Beyer et al. | 156/645 |
| 5,023,991 | 6/1991 | Smith | 29/603 |
| 5,036,015 | 7/1991 | Sandhu et al. | 437/8 |
| 5,132,617 | 7/1992 | Leach et al. | 324/207.16 |

*Primary Examiner*—Rolf Hille
*Assistant Examiner*—S. V. Clark
*Attorney, Agent, or Firm*—Gerald E. Linden

[57] ABSTRACT

A contact structure is formed atop a semiconductor wafer at a level whereat it is desired to terminate polishing of a layer overlying the contact structure. When the contact structure becomes exposed to a polishing slurry, an electrical characteristic, such as resistance or impedance, is registered by measuring apparatus. In one embodiment, two or more contact structures are formed atop the wafer, vias are formed through the wafer, and the vias are filled, thereby providing a conductive path from the contact structures to the back side of the wafer. The measuring apparatus probes the filled vias on the back side of the wafer. A change in resistance/impedance indicates that the contact structures have become exposed during polishing, and polishing is terminated. In another embodiment of the invention, one or more contact structures are formed atop the wafer. The measuring apparatus is connected to a probe in the polishing slurry, and to the wafer itself, such as to the back side of the wafer. Again, a change in resistance/impedance indicates that the contact structures have become exposed during polishing, and polishing is terminated.

4 Claims, 1 Drawing Sheet

DETECTING THE ENDPOINT OF CHEM-MECH POLISHING, AND RESULTING SEMICONDUCTOR DEVICE

This application is a division of application Ser. No. 07/911,851, filed Jul. 10, 1992, now U.S. Pat. No. 5,265,378.

TECHNICAL FIELD OF THE INVENTION

The present invention relates to the fabrication of semiconductor devices, such as integrated circuits (ICs), and more particularly to planarizing the irregular top surface of a semiconductor wafer being processed into ICs.

BACKGROUND OF THE INVENTION

In the process of fabricating modern semiconductor integrated circuits (ICs), it is necessary to form conductive lines or other structures above previously formed structures. However, prior structure formation often leaves the top surface topography of the in-process silicon wafer highly irregular, with bumps, areas of unequal elevation, troughs, trenches and/or other surface irregularities. As a result of these irregularities, deposition of subsequent layers of materials could easily result in incomplete coverage, breaks in the deposited material, voids, etc., if it were deposited directly over the aforementioned highly irregular surfaces. If the irregularities are not alleviated at each major processing step, the top surface topography of the surface irregularities can become even more irregular, causing further problems as layers stack up in further processing of the semiconductor structure.

Depending upon the type of materials used and their intended purposes, numerous undesirable characteristics are produced when these deposition irregularities occur. Incomplete coverage of an insulating oxide layer can lead to short circuits between metallization layers. Voids can trap air or processing gases, either contaminating further processing steps or simply lowering overall device reliability. Sharp points on conductors can result in unusual, undesirable field effects. In general, processing high density circuits over highly irregular structures can lead to very poor yield and/or device performance.

Consequently, it is desirable to effect some type of planarization, or flattening (levelling), of integrated circuit structures in order to facilitate the processing of multi-layer integrated circuits and to improve their yield, performance, and reliability. In fact, all of today's high-density integrated circuit fabrication techniques make use of some method of forming planarized structures at critical points in the fabrication process.

Planarization techniques generally fall into one of several categories:

1. Purely mechanical polishing (or abrading) techniques, wherein an abrasive is used to planarize the surface;

2. Chemical/mechanical (chemi-mechanical, chem-mech) polishing techniques, wherein a slurry of abrasive and a chemical, such as KOH (potassium hydroxide) is used;

3. Leveling the top surface with a filler material, then wet (chemical) or dry (plasma) etching back the filler and irregularities; and 4. Reflow techniques requiring spinning and/or elevated Different techniques may be selected depending on the material being levelled (planarized), and the particular stage of IC fabrication at which the planarization is performed. One feature that the various techniques have in common, however, is a general need to know when planarization is complete. Else, it can be allowed to proceed too far, removing underlying material which is intended to be planarized rather than removed (unacceptably thinned).

Consider, for example, the case of etching to planarize an irregular semiconductor layer. An overlying, sacrificial layer (e.g., photoresist, glass) may be applied using spin-on or reflow processes, in which the overlying layer tends to flatten (planarize) itself. The wafer is then either wet or dry etched with an etchant that removes the overlying layer and elevated points of underlying layer (as they become exposed) at a uniform rate. In this manner, the two layers are thinned uniformly and planarly, including the "mountains" (elevated irregularities) of the underlying irregular layer, until a smooth, flat (planarized) surface remains on the underlying layer. Etching must stop at this point—the "endpoint" of the process.

U.S. Pat. No. 4,491,499, incorporated by reference herein, discloses a method for determining the optimum time at which a plasma etching operation should be terminated, based on optical emissions in the plasma.

U.S. Pat. No. 4,312,732, incorporated by reference herein, discloses another method for monitoring plasma discharge processing operations. Generally, both an overlying and an underlying material, emit spectral signatures in the plasma. In one case, an endpoint is determined when the monitored intensity of the overlying layer species falls below a predetermined threshold level (indicating that the overlying layer is nearly fully etched away). In another case, when the monitored intensity of the underlying species rises above a preselected level (indicating that the underlying layer is nearly fully exposed), etching is terminated.

The methods set forth in the two patents described above are applicable to plasma etching. They are not applicable to chemical/mechanical polishing. Chemical/mechanical (chemimechanical, chem-mech) polishing is described in U.S. Pat. Nos. 4,671,851, 4,910,155, 4,944,836, all of which patents are incorporated by reference herein.

Generally, chem-mech polishing involves rubbing a wafer with a polishing pad in a slurry containing both an abrasive and chemicals. Typical slurry chemistry is KOH (Potassium Hydroxide), having a pH of about 11. A typical silica-based slurry is "SC-1" available from Cabot Industries. Another, more expensive slurry based on silica and cerium (oxide) is Rodel "WS-2000". When chemimechanical polishing is referred to hereinafter, it should be understood to be performed with a suitable slurry.

In many cases, chem-mech polishing can remove material at a greater rate than plasma etching. In any case, there is no plasma in which to monitor spectral content in order to determine the endpoint of chem-mech polishing.

U.S. Pat. No. 5,036,015, incorporated by reference herein, discloses a method of endpoint detection during chemical/mechanical planarization of semiconductor wafers. The endpoint is detected by sensing a change in friction between the wafer and the polishing surface (polishing pad). This change of friction may be produced when, for example, an (overlying) oxide coating on the wafer is removed and a harder or softer (underlying) material is contacted by the polishing surface. Friction is detected by monitoring the electric current supplied to motors rotating the wafer and the polishing surface.

Although the method described in U.S. Pat. No. 5,036,015 aptly identifies the need for detecting endpoint when chem-mech polishing, it does so in a rather "indirect" manner (sensing motor current) and assumes that the overlying material has a different coefficient of friction than the underlying material. Regarding the latter, the method will simply not work if the coefficients of friction of the overlying and underlying materials are not sufficiently different to allow detecting a change in friction. Further, the friction will change (e.g., increase or decrease) as the materials become more and more planar (e.g., more area being polished), and the slurry becomes depleted. Moreover, coefficients of friction ar "mechanical" rather than "electrical" characteristics of a material, and are not of paramount concern in the selection of semiconductor materials. Additionally, the method of the patent would be defeated by changes in bearing friction, such as the motor bearings. Also, it is evident that the change in sensed friction between polishing away an overlying layer and exposing an underlying layer may be gradual, and extremely difficult to characterize, especially when "mountainous" topological features of the underlying layer are extending into the overlying layer and are becoming gradually exposed during polishing. Perhaps even more significantly, the technique of the patent is not suited to polishing a single, irregular layer since, in such a case, there would be no "overlying" layer with a different coefficient of friction than the underlying layer.

Moreover, chem-mech polishing is believed to be characterized by three distinct phases, each of which would introduce its own variables into the friction between pad and wafer. Namely:

1. *Planarization* In a "Planarization Phase", only the highest parts of the top surface are removed.

2. *Smoothing* In a "Smoothing Phase", all parts of the top surface are being polished back, but at different rates.

3. *Blanket Polish Back* In a "Blanket Polish Back" phase, all parts of the top surface are removed at an equal rate.

DISCLOSURE OF THE INVENTION

It is therefore an object of the present invention to provide an improved technique for detecting endpoint in chem-mech polishing.

It is a further object of the present invention to provide a technique for detecting endpoint in chem-mech polishing that is insensitive (not dependent) upon mechanical characteristics of a semiconductor material being polished.

It is a further object of the present invention to provide a technique for detecting endpoint in chem-mech polishing that is relatively insensitive to depletion of abrasives in the slurry, that is relatively insensitive to the amount of planarization that has occurred, and that is relatively insensitive to the phase of polishing at a given moment.

It is a further object of the present invention to provide a technique for directly detecting the endpoint of chem-mech polishing.

It is further object of the present invention to provide a technique for detecting the endpoint of chem-mech polishing of a single topographical (non-planar) layer.

According to the invention, a contact (conductive) structure is formed atop a semiconductor wafer at a level whereat it is desired to terminate polishing of a layer overlying the contact structure. When the contact structure becomes exposed to a polishing slurry, an electrical characteristic, such as resistance or impedance, is registered by measuring apparatus.

In one embodiment of the invention, two or more contact structures are formed atop the wafer, vias are formed through the wafer, and the vias are filled, thereby providing a conductive path from the contact structures to the back side of the wafer. The measuring apparatus probes the filled vias on the back side of the wafer. A change in resistance/impedance indicates that the contact structures have become exposed to the polishing slurry during polishing, and polishing is terminated.

In another embodiment of the invention, one or more contact structures are formed atop the wafer. The measuring apparatus is connected to a probe in the polishing slurry, and to the wafer itself, such as to the back side of the wafer. Again, a change in resistance/impedance indicates that the contact structures have become exposed during polishing, and polishing is terminated.

Other objects, features and advantages of the invention will become apparent in light of the following description thereof.

DETAILED DESCRIPTION OF THE INVENTION

Figure 1:
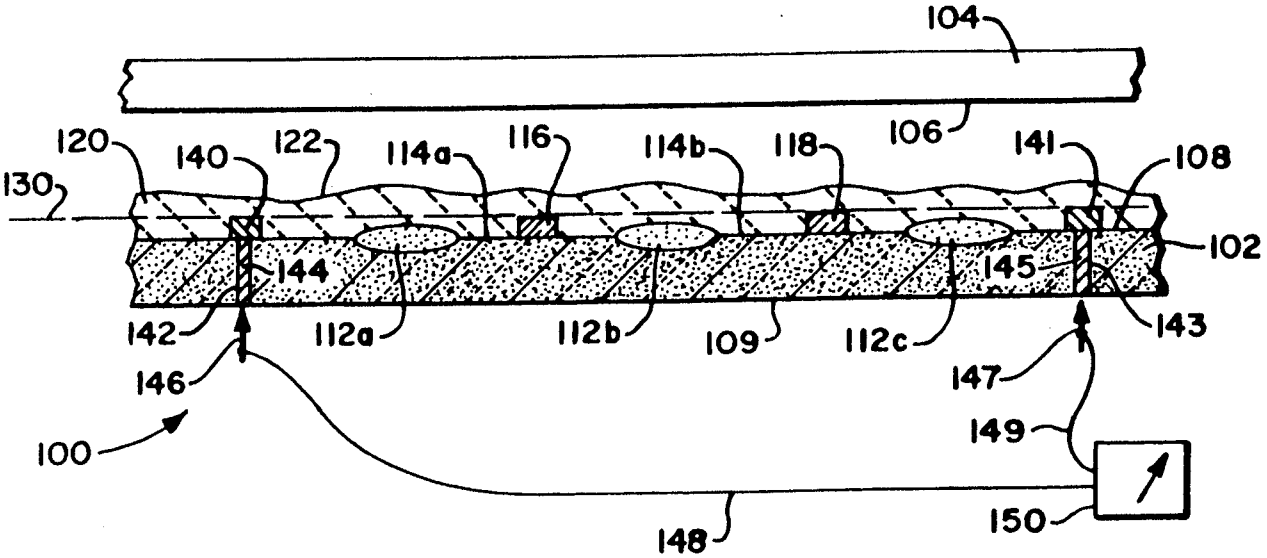
FIG. 1 is a partial cross-sectional view of a semiconductor wafer, showing (exploded) a polishing pad, and showing in schematic form measuring apparatus, according to the present invention.

FIG. 1 illustrates a technique 100 for directly detecting the endpoint of chem-mech polishing a semiconductor wafer 102 with a polishing pad 104. In the view of FIG. 1, the pad 104 is shown above the wafer 102, for clarity. It should be understood that the bottom surface 106 of the pad will act directly upon the top (as viewed) surface of the wafer, in the presence of polishing slurry, in order to effect "chem-mech" polishing. The wafer 102 may be a complete wafer, or it may simply be viewed as a semiconductor substrate. Such substrates are typically formed of silicon, but they may also be formed of sapphire, or from other materials.

It should be understood that the present invention is applicable to any polishing process, such as that shown in U.S. Pat. No. 4,910,155, incorporated by reference herein.

The top surface 108 of the wafer 102 is initially flat (planar), and is subsequently processed to form circuit elements. This involves various deposition steps, etching steps, masking steps, and the like, all of which are well known, and which depend on the particular circuit elements sought to be fabricated.

By way of illustration field oxide (FOX) regions 112*a*, 112*b* and 112*c* may be formed on the wafer. As illustrated, these field oxide regions extend above the top surface of the wafer. In this sense, they are "topographical" features.

Regions 114a and 114b, between the regions 112a/112b and 112b and 112c, respectively, are often referred to as "islands". In these islands 114a and 114b, various diffusions, implantations, and the like are performed to create transistor elements (e.g., source, drain), and the like. Showing such is not necessary to an understanding of the present invention.

Additionally, semiconductor features may be fabricated on the top surface of the wafer. Focusing our attention on such features in the island areas, FIG. 1 shows features 116 and 118 formed atop respective island areas 114a and 114b. These features 116 and 118 may be polysilicon gates, conductive metal lines, or the like.

By way of further example, an insulating layer 120 is deposited atop the wafer. This is well known, as is forming vias through the insulating layer to interconnect overlying metal layers to points on the wafer (and/or to the gate structure). Commonly-owned U.S. Pat. Nos. 4,708,770 and 4,879,257 are illustrative of this, and are incorporated by reference herein.

Notably, the top surface 122 of the insulating layer 120 is topographical—in other words, irregular and non-planar. Generally, it conforms to the irregular top surface topography of the wafer. In order that subsequent layers (not shown) can be applied over a planar surface, it is necessary to planarize the top surface of the insulating layer 120. For example, in the aforementioned U.S. Pat. No. 4,879,257, it is shown that a layer of dielectric material (24) is sought to be planarized, albeit by etching, albeit after metal filling of vias (26), and albeit for vias to metal runners (18 and 20) rather than gates.

According to the invention, a topographical wafer (wafer having an irregular top surface) is desired to be chem-mech polished to a certain point, at which the polishing must stop. This point is referred to as the a "endpoint" of polishing. Returning to the illustration of FIG. 1, it is desired to polish back the insulating layer 120 until the gate structures 116 and 118 are exposed. Ancillary to this, it is desired that the gate structures are not significantly polished (thinned). Dashed line 130 indicates such a point (plane) above the wafer surface at which it is desired to stop polishing.

The polishing pad 104 is brought into contact with the top surface of the insulating layer 120, and the layer 120 is progressively thinned. As mentioned above, this occurs in three phases:

1. A "Planarization Phase", in which only the highest parts of the top surface are removed.

2. A "Smoothing Phase", in which all parts of the top surface are being polished back, but at different rates.

3. A "Blanket Polish Back" phase, in which all parts of the top surface are removed at an equal rate.

Further according to the invention, a mechanism is incorporated into the semiconductor wafer itself to provide a direct indication of having achieved the endpoint of polishing—in other words, the point at which the layer 120 has been removed to the desired level 130.

A conductive structure 140, such as a metallic button or a "dummy" (inoperative) polysilicon gate, is formed atop the wafer, and extends above the surface of the wafer to a height corresponding to the desired endpoint 130. The conductive dummy structure is preferably formed of the same material and in the same fabrication step as a feature desired to exposed, if applicable. Or, it can be formed in a separate processing step. The conductive dummy structure 140 should, nevertheless, preferably be formed in a "sacrificial" area of the wafer, whereat it is not desired to form active components. This may be in the scribe lines between dies, or in the field oxide (FOX) regions, for example.

In one embodiment of the invention, at least two conductive dummy structures 140 are formed, shown as 140 and 141 in FIG. 1, at two (or more) spaced-apart positions on the semiconductor wafer. The use of two conductive structures 140 and 141 is discussed, for illustrative clarity.

Prior to forming the conductive structures 140 and 141, via 142 and 143, respectively, are formed completely through the wafer, such as by ion milling, etching, or the like, at positions directly underneath the respective conductive structures 140 and 141. The vias 142 and 143 are filled with a conductive material 144 and 145, respectively, using standard via-filling techniques, forming "plugs" extending from the top surface of the wafer to the bottom surface 109 thereof.

Electrical probes 146 and 147 (shown schematically) are brought into contact with the plugs 144 and 145, from the back side 109 of the wafer. These probes may simply be contact points embedded in a stage (not shown) supporting the wafer during polishing. The probes 146 and 147 are connected, via lines 148 and 149, respectively, to inputs of an apparatus 150 suited to measuring resistance, impedance, or the like.

In use, as polishing proceeds, the overlying layer 120 becomes progressively thinned and flattened. Eventually, the desired level 130 is reached, at which point it is desired to terminate polishing. Evidently, at this point (130) the conductive structures 140 and 141 have just become exposed (by definition). Hence, they suddenly become in contact with the polishing slurry (not shown), and with the polishing pad. (Prior to becoming exposed, the contact (conductive) structures would have been "insulated" from the polishing slurry by the overlying layer.)

When the contact structures 140 and 141 become exposed to slurry, this will register as a change in the measured resistance/impedance on the measuring apparatus 150. Any suitable signalling means (not shown), such as a light or a polishing motor shutoff relay may be employed to terminate polishing.

It should be understood that the contact structures 140 and 141 need not be disposed directly on the top surface 108 of the wafer, but can also be located atop or within an overlying layer, so that the technique of detecting polishing endpoint of the present invention can be practiced at any desired stage of semiconductor fabrication.

It should also be understood that the vias 142 and 143 extending through the wafer may be "offset" from the locations of the conductive structures 140 and 141, and connected thereto by conductive lines or the like already formed or specifically formed on the wafer.

In the previous embodiment, two or more conductive structures were formed atop the wafer to become exposed at the endpoint of polishing, and vias were formed through the wafer to permit probing from the back side 109 of the wafer.

In another embodiment of the invention, vias through the wafer are not required.

Figure 2:
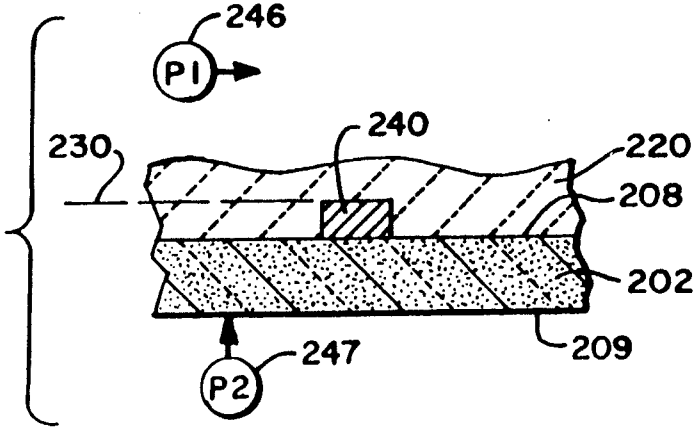
FIG. 2 is a partial cross-sectional view of a semiconductor wafer, showing another embodiment of the invention.

FIG. 2 shows another embodiment of the invention. A semiconductor wafer 202 has a dummy contact structure 240 formed on it top surface 208 (or in or on any suitable layer overlying the top surface). An overlying layer 220 is intended to be polished (polishing pad not shown; see FIG. 1), until a predetermined level (dashed line 230) is attained—the level corresponding to the top surface of the contact structure 240. This is all similar to the embodiment shown in FIG. 1. Field oxides, polysilicon gates, and the like are omitted from FIG. 2, for descriptive clarity. (For a discussion of these "typical" elements, see FIG. 1).

A first probe "P1" 246 is disposed at any suitable location in the polishing slurry (not shown). A second probe "P2" 247 is in contact with the back side 209 of the wafer. The second probe 247 may be brought into contact with the back side of the wafer by being connected to a metallic wafer support stage (not shown). The probes 246 and 247 are connected to suitable measuring apparatus (compare 150, FIG. 1).

Consider the case of polishing an overlying insulating layer 220. While the layer 220 is being thinned, the contact structure 240 is insulated from the slurry, and the measuring apparatus indicates a relatively high resistance/impedance. Upon reaching the predetermined level 230, the contact 240 becomes exposed to the polishing slurry, and the measuring apparatus indicates a relatively low resistance/impedance.

In contrast to the prior art technique of indirectly determining polishing endpoint by sensing mechanical, frictional changes during polishing (e.g., U.S. Pat. No. 5,036,015), the present invention provides a direct, electrical, reliable technique of determining the endpoint of polishing. Whereas the technique of the aforementioned U.S. Pat. No. 5,036,015 requires disparate and significant frictional characteristics between layers, such is not required by the present invention. Rather, the present invention relies on detectable changes in impedance/resistance and is based on a fixed parameter (resistance/impedance) of the slurry. Hence, the technique of the present invention is useful for detecting endpoint when polishing a wide variety of semiconductor materials.

What is claimed is:

1. A semiconductor wafer, comprising:

a semiconductor wafer having a top surface and a bottom surface;

semiconductor circuit elements formed on the top surface of the wafer;

an irregular layer of insulating material overlying the semiconductor structures; and at least one conductive "dummy" structure formed in the wafer, and extending to a level above the top surface of the wafer at a point whereat it is desired to terminate subsequent polishing of the overlying layer, the at least one conductive dummy structure being electrically isolated from the circuit elements.

2. A semiconductor wafer, according to claim 1, further comprising:

at least two conductive dummy structures;

vias formed through the semiconductor wafer, said vias extending through the wafer to the bottom surface of the wafer, the vias being in electrical contact with respective dummy structures; and conductive material filling the vias.

3. A semiconductor wafer having embedded structures for establishing an endpoint of polishing in a process of polishing material overlying the embedded structures, comprising:

a semiconductor wafer having a top surface;

a plurality of circuit elements formed on the top surface of the semiconductor wafer, a conductive structure formed on the top surface of the wafer and electrically isolated from the plurality of circuit elements, the conductive structure extending to a height above the top surface of the semiconductor wafer to a level, the level being selected as a level whereat it is desired to terminate polishing of at least one layer of material disposed on the surface of the wafer;

at least one layer of material overlying the top surface of the semiconductor wafer and completely covering the conductive structure.

4. A semiconductor wafer, according to claim 3, further comprising:

a plurality of conductive structures formed on the top surface of the wafer, all of the conductive structures extending to a common level above the top surface of the semiconductor wafer;

vias through the semiconductor wafer, said vias extending completely through the wafer from the top surface of the wafer to an opposite bottom surface of the wafer, the vias being in electrical contact with respective conductive structures; and conductive material filling the vias.

* * * * *